US005437417A

United States Patent [19]

Kammann

[11] Patent Number: 5,437,417

[45] Date of Patent: Aug. 1, 1995

[54] DEVICE FOR WINDING A WEB

[75] Inventor: Rolf Kammann, Westerkappeln-Velpe, Germany

[73] Assignee: Windmöller & Hölscher, Lengerich, Germany

[21] Appl. No.: 137,791

[22] Filed: Oct. 19, 1993

[30] Foreign Application Priority Data

Oct. 19, 1992 [DE] Germany ..... 9214095 U
Nov. 30, 1992 [DE] Germany ..... 9216261 U

[51] Int. Cl.[6] ..... B65H 18/08

[52] U.S. Cl. ..... 242/541.1; 242/412.1; 242/413.1; 242/413.2; 242/413.3

[58] Field of Search ..... 242/541.1, 412, 412.1, 242/412.2, 412.3, 413, 413.1, 413.2, 413.3, 413.4, 413.5, 413.9

[56] References Cited

U.S. PATENT DOCUMENTS 3,871,598 3/1975 Kataoka ..... 242/541.1 X
4,508,284 4/1985 Kataoka ..... 242/413.1
4,634,069 1/1987 Kataoka ..... 242/413.5
4,697,755 10/1987 Kataoka ..... 242/541.1 X
5,275,348 1/1994 Looser ..... 242/413.1

*Primary Examiner*—John P. Darling
*Attorney, Agent, or Firm*—Keck, Mahin & Cate

[57] ABSTRACT

A device for winding a web, preferably a plastic film web produced in a blowing or casting process, includes a driven winding tube for a web, a web tension measuring roller, a driven contact roller positioned between the winding tube and the web tension measuring roller which, in the case of contact winding, can be positioned against the film roll being formed and which, in the case of gap winding, is positioned at a distance from the film roll. A control device controls the motors as a function of the feeding speed of the web and in accordance with the measured tractive force of the web, such that the coil hardness of the wound roll can be predetermined. In the case of contact winding, the torque of the winding motor is controlled according to the increasing diameter of the wound roll and the contact roller is driven at a speed that is controlled according to the tractive force of the web. In the case of gap winding, the speed of the winding motor is controlled according to the measured tractive force of the web.

4 Claims, 2 Drawing Sheets

DEVICE FOR WINDING A WEB

FIELD OF THE INVENTION

The invention relates to a device for winding a web, preferably a web of plastic film produced in a blowing or casting process, with a winding tube for the web, driven by an electric winding motor, a web tension measuring roller, a contact roller which is positioned between the winding tube and the web tension measuring roller and is driven by an electro-motor and which can be positioned against the growing film roll in the case of contact winding and positioned at a distance from the film roll in the case of gap winding, and with a control unit to control the motors as a function of the feeding speed of the web in accordance with the measured tractive force of the web, in such a way that the coil hardness of the wound roll can be influenced in a predetermined manner.

To prevent the individual plies of a film roll from migrating in an axial direction or telescoping outward, which may occur particularly when air cushions form between the individual plies at the beginning of the winding process, a winding process is desirable in which the coil hardness of the film rolls decreases from inside outward. If air cushions form at the beginning of winding, for example, between the individually wound plies, the enclosed air is pressed out as the roll diameter increases and there is a danger of the individual plies also migrating laterally at the same time that the air is squeezed out. This may result in the individual film plies telescoping outward in such a way that the film roll is no longer usable and becomes a reject.

BACKGROUND OF THE INVENTION

A known winding device of the initially described type, with a corresponding control system, for producing wound rolls whose hardness can be influenced in a predetermined manner, will now be described on the basis of the schematic view shown in FIG. 1.

FIG. 1 illustrates a central contact winding device. In this winding device the web 1 being wound is introduced by means of a contact roller 2 contacting the winding tube 3, or to the film roll 4 that forms on this winding tube, and is wound onto the film roll 4; the contact roller is positioned against the circumference of the film roll 4 that is forming. Positioned in front of the contact roller is a web tension measuring roller 5, which measures the tractive force of the film web running over the contact roller 2. The web tension measuring roller 5 forms a web loop or diverts the web 1, so that the tractive force can be determined from the tension exerted on the web tension measuring roller 5 by the incoming and outgoing portions of the web. Assigned to the web tension measuring roller 5 is a receiver 6 for the measured data, which feeds a signal corresponding to the measured tractive force of the web to a control device, for example, a computer 7. This computer 7 compares the signal obtained from the receiver 6 as an actual value with a desired value stored in the computer 7. If the two signals differ, the speed of the direct-current motor 8 driving the contact roller 2 will be controlled in a positive or negative fashion, specifically in such a way that the actual value fed from the receiver 6 to the computer corresponds to the desired value.

Since the diameter of the film roll 4 increases with the winding time, the motor 9 driving the winding tube 3 and the film roll 4 forming on it must also be regulated according to the increasing diameter of the film roll 4. This is provided for in that a sensor 10 monitors the winding tube 3 or the pins or journals supporting the winding tube 3, and the sensor 10 determines the actual diameter of the film roll 4 by means of the counted revolutions of the winding tube 3. This value provides a measure for changing the torque of the winding motor 9. The torque of the winding motor 9 is controlled accordingly. Thus, the torque of the motor 9 is changed in accordance with the diameter of the film roll that is forming and in accordance with the desired winding characteristics, while the speed of the motor 8 which drives the contact roller 2 is also controlled.

As described, a winding device operating as a central contact winding device is shown in FIG. 1, in which both the contact roller and the winding tube on which the web is wound are driven and both are in continuous contact with each other.

In a different system, the contact roller 2 is moved away from the winding tube 3, or the wound roll 4 that forms on this tube, and is positioned at a distance from the tube. Winding of this kind is referred to as "central gap winding". This mode of operation is always preferred when highly sensitive films must be wound, which run the risk of being damaged by contact pressure from the contact roller.

If the wound rolls are wound by a central gap winding method, the winding motor 8 and the motor 9 driving the contact roller 2 are controlled in the manner described above. A different type of control has not previously been thought possible, inasmuch as the web tension between the winding tube 3, or the film roll 4 forming on the tube, and the displaced contact roller could not be measured, as it was impossible to house measuring devices in the immediate area. If the known winding device described in FIG. 1 is operated as a central gap winding device, the torque of the winding motor is controlled according to the increasing diameter of the wound roll 4 that is in the process of forming in such a way that the desired winding characteristic is obtained. Controlling the torque of the winding motor is only able to provide the desired winding characteristic in a very imprecise fashion, however, so that controlling the torque of the winding motor is no longer adequate for the increased demands with respect to the characteristic of coil hardness in the case of wound rolls with sensitive types of film.

SUMMARY OF THE INVENTION

An object of the present invention, therefore, is to create a device of the initially described type, by means of which sensitive films can be wound into film rolls by central gap winding and in which it is possible to vary the coil hardness in a manner appropriate for sensitive film types.

The problem is solved by providing a device in which, in the case of central contact winding, the torque of the winding motor is controlled according to the increased diameter of the wound roll and the contact roller is driven at a speed that is controlled according to the tractive force of the web, while in the case of central gap winding, the speed of the winding motor is controlled according to the measured tractive force of the web.

Sensitive winding of the web, preferably a plastic film web, into a film roll with a desired coil hardness characteristic is made possible when the wound roll is driven at a speed that is controlled according to the tractive force of the web running onto the film roll. With this method of controlling the coil hardness it is possible to sensitively establish the tension or web tractive force with which each individual ply is wound and to adjust that tension to a desired coil characteristic. Controlling the coil hardness by controlling the winding motor speed makes it possible to avoid deviations in coil hardness, such as arise when the torque of the winding motor is controlled, given that such control is necessarily imprecise due to both inertia and the limited adjustment capability for different torques over the diameter of the wound roll.

In a device according to the invention, controlling the winding motor speed permits the sensitive adjustment of the coil hardness to the desired winding characteristic when the effect of the contact roller on the tractive force of the web is eliminated. In a preferred embodiment of the invention with central gap winding the motor torque of the contact roller exhibiting a gap for the wound roll is controlled in such a way that the motor torque compensates for the inertia of the contact roller. In this device, the inertia of the contact roller is no longer able to alter the tractive force of the web as measured by the web tension measuring roller, with the result that the tractive force of the web, as measured by the web tension measuring roller, can be employed to sensitively control the winding motor speed. Furthermore, in controlling the torque of the contact roller motor the effects of friction can be taken into account and compensated for.

The device according to the invention can thus be used both as a central contact winding device and as a central gap winding device, with the motor of the winding roller being controlled with respect to torque and the motor of the contact roller being controlled with respect to speed in the case of central contact winding. In the case of central gap winding, the winding motor of the winding roller is controlled with respect to speed and the contact roller is controlled with respect to torque only in the sense that the contact roller no longer has an effect on the tractive force of the web. The motors can be reversed accordingly in a simple manner by a control unit.

It is expedient for the winding motor and contact roller motor to be direct-current motors, since such motors can be controlled with respect to torque and speed in a particularly simple way. In direct-current motors the torque is proportional to the armature current $I_A$ and the revolutions per minute (rpm) is approximately proportional to the armature voltage $U_A$. When the torque is controlled, the web can be wound onto the winding roller with a tractive force that can only roughly be predetermined.

DETAILED DESCRIPTION OF THE PREFERRED EMBODIMENTS

An exemplary embodiment of the invention will now be described with respect to FIG. 2, which schematically depicts a winding device which can be converted from central contact winding to central gap winding and vice-versa.

Figure 1:
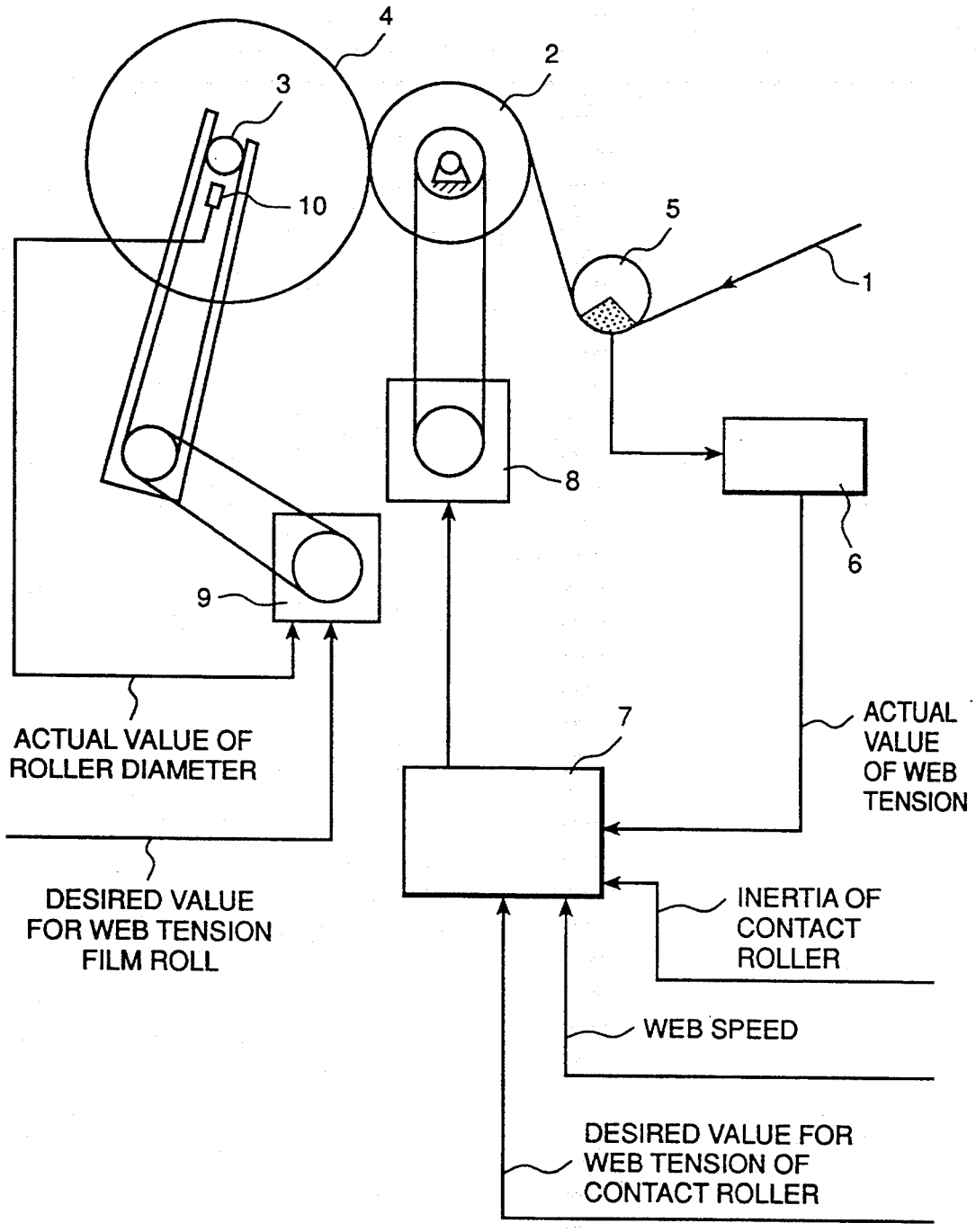
Fig. 1 (PRIOR ART)
FIG. 1 is a schematic view of a winding device of the prior art.
Figure 2:
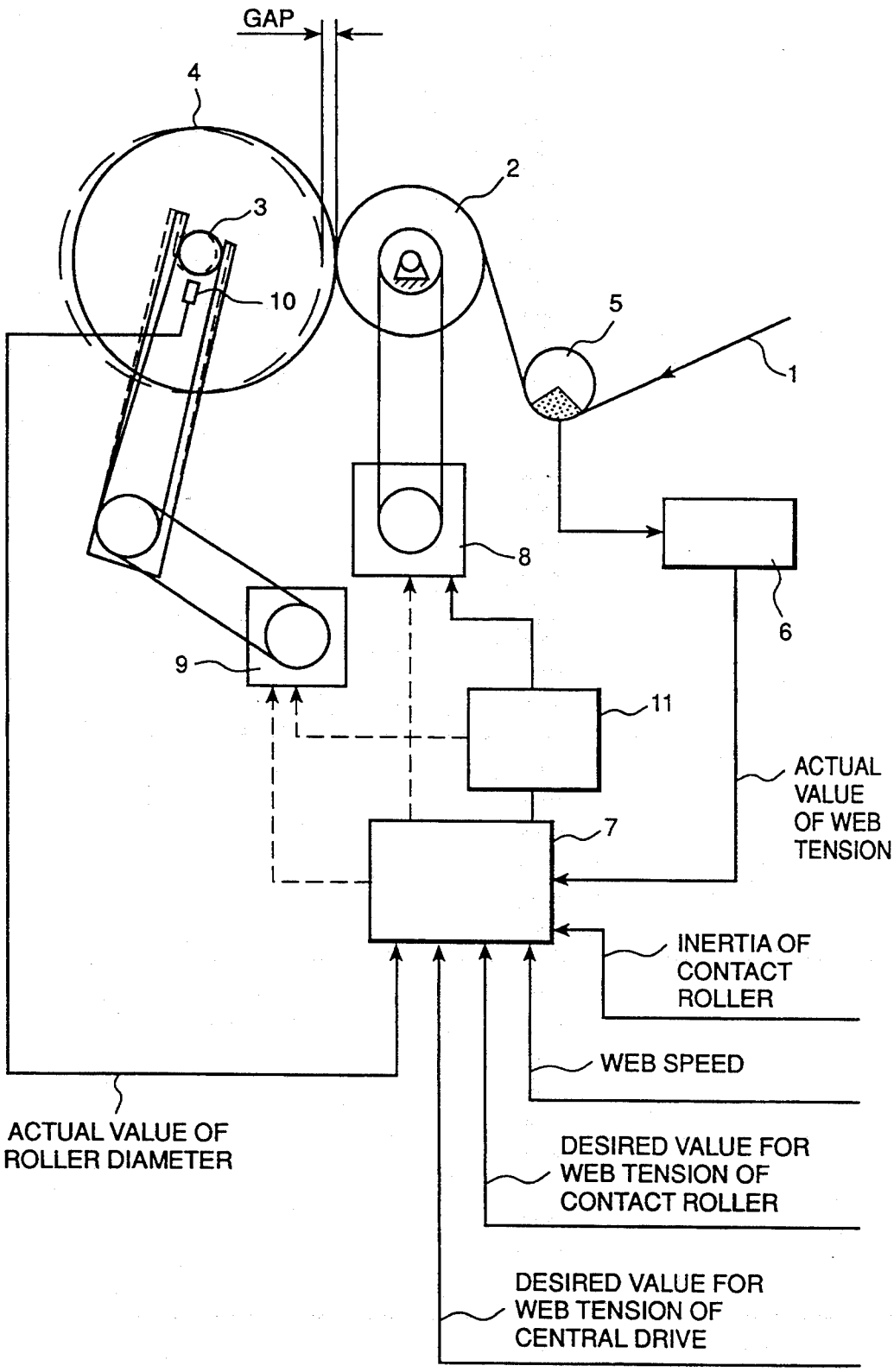
FIG. 2 is a schematic view of a device of the invention which shows a winding device which can be converted from central contact winding to central gap winding and vice-versa.

In the mode of operation shown in FIG. 2 the device operates as a central contact winding device, similarly to the the description above with respect to the winding device shown in FIG. 1. The type of control shown in FIG. 2 is thus identical to that of the device shown in FIG. 1, and reference numerals used in FIG. 1 are used for identical parts in FIG. 2.

If the device shown in FIG. 2 is switched from the depicted mode of operation as a central contact winding device to the mode of operation of a central gap winding device, the contact roller 2 always exhibits a spacing interval or gap relative to the film roll 4 as shown in FIG. 2. In order to provide sensitive control of the winding characteristic of the film roll 4, the motors 8 and 9 are switched over, specifically, in such a way as to control the speed of motor 9 and the torque of motor 8. In this operating mode the signal fed from the web tension measuring roller 5 to the computer 7 via the receiver 6 in order to regulate the speed of motor 9 is employed for the film roll 4. The corresponding desired value for the characteristic of film hardness as the film roll grows in diameter is stored in the computer 7. The desired values and the actual values are continually compared, and this comparison provides the basis on which the winding motor 9 is regulated according to speed.

The motor 8 of the contact roller 2, which in gap winding merely serves as a guide roller, is controlled with respect to torque only in that it compensates for the physical mass of the contact roller 2 and for the friction arising from the contact drive and in that it keeps the contact roller 2 in rotation in accordance with the speed of the web passing over it, without exerting a reactive force on the web. Thus the contact roller 2 operating in gap mode does not exert a tractive force on the fed film web 1. The value established by the web tension measuring roller 5 thus corresponds to the web tractive force, which also obtains between the contact roller 2 and the film roll 4. Since the characteristic of coil hardness is thus assured by controlling the speed of the film roll, the coil hardness of the film roll can be very sensitively determined.

To convert the device according to the invention from contact winding to gap winding all that is necessary is to provide the control device or the computer 7 with a commutation capability 11, such that there is torque control of the motor 9 and speed control of the motor 8 and, in gap operation, speed control of the motor 9 and torque control of the motor 8.

What is claimed is:

1. A device for winding a web, preferably a plastic film web produced in a blowing or casting process, comprising:

a winding tube for a web, driven by an electric winding motor;

a web tension measuring roller for measuring tension of the web;

a contact roller positioned between the winding tube and the web tension measuring roller driven by a motor and which for contact winding can be positioned against a film roll that is in the process of forming, and which for gap winding is positioned at a distance from the film roll; and a control device for controlling the motors as a function of feeding speed of the web and in accordance with measured tension of the web, such that coil hardness of a wound film roll can be influenced in a predetermined way; wherein:

for contact winding torque of the winding motor (9) is controlled according to increasing diameter of the wound film roll and the contact roller (2) is driven at a speed that is controlled according to the measured tension of the web, and for gap winding the speed of the winding motor (9) is controlled according to the measured tension of the web.

2. A device according to claim 1, wherein for gap winding the motor (8) of the contact roller (2), which is separated by a gap from the wound film roll (4), is controlled with respect to its torque so that torque of the motor compensates for inertia of the contact roller (2) and for friction arising from a drive thereof.

3. A device according to claim 2, wherein the motors (8, 9) for driving the contact roller (2) and the winding tube (3) respectively are direct-current motors.

4. A device according to claim 1, wherein the motors (8, 9) for driving the contact roller (2) and the winding tube (3) respectively are direct-current motors.

* * * * *